US009394095B2

(12) United States Patent
Hartman et al.

(10) Patent No.: US 9,394,095 B2
(45) Date of Patent: Jul. 19, 2016

(54) TRANSACTION PRODUCT ASSEMBLY WITH SEPARABLE PARTS FOR REASSEMBLY

(71) Applicant: TARGET BRANDS, INC., Minneapolis, MN (US)

(72) Inventors: David Andrew Hartman, Minneapolis, MN (US); Brenda Irlbeck, Minneapolis, MN (US); Aaron Muther, Crystal, MN (US); Brian R. Holt, Minneapolis, MN (US); Eduardo Hernandez, Minneapolis, MN (US); Megan B. Engeseth, Minneapolis, MN (US); Timothy P. Clegg, Manhatten Beach, CA (US); Anthony V. Roberts, Rolling Hills Estates, CA (US)

(73) Assignee: Target Brands, Inc., Minneapolis, MN (US)

( * ) Notice: Subject to any disclaimer, the term of this patent is extended or adjusted under 35 U.S.C. 154(b) by 159 days.

(21) Appl. No.: 14/138,122

(22) Filed: Dec. 22, 2013

(65) Prior Publication Data

US 2014/0183074 A1 Jul. 3, 2014

Related U.S. Application Data

(60) Provisional application No. 61/747,245, filed on Dec. 29, 2012.

(51) Int. Cl.

| | |
|---|---|
| ***B65D 85/00*** | (2006.01) |
| ***B65D 73/00*** | (2006.01) |
| ***A63H 27/00*** | (2006.01) |

(52) U.S. Cl.

CPC ..... *B65D 73/0014* (2013.01); *A63H 27/001* (2013.01); *B65D 2203/00* (2013.01)

(58) Field of Classification Search

USPC ..... 206/461, 467, 471, 216, 223, 577

See application file for complete search history.

(56) References Cited

U.S. PATENT DOCUMENTS

| | | | |
|---|---|---|---|
| 1,758,399 | A | 5/1930 | Hodgdon |
| 2,058,265 | A | 10/1936 | Selley |

(Continued)

FOREIGN PATENT DOCUMENTS

| | | |
|---|---|---|
| GB | 1325272 | 8/1973 |

OTHER PUBLICATIONS

Photograph of Snap Apart Letters in Frame Publicly Available from Tamiya in Huay Kwang, Bangkok, India, Admitted Prior Art (1 page).

(Continued)

*Primary Examiner* — Jacob K Ackun

(74) *Attorney, Agent, or Firm* — JoAnn M. Seaton; Griffiths & Seaton PLLC

(57) ABSTRACT

A transaction product assembly includes a perimeter frame defining a footprint, a plurality of parts maintained within the footprint of the perimeter frame, a transaction card, and a plurality of sprues. The transaction card includes a machine-readable account identifier linking the transaction card to an account or record, wherein the transaction card is maintained within the footprint of the perimeter frame. The plurality of sprues extend between the perimeter frame, the plurality of parts, and the transaction card to hold perimeter frame, the plurality of parts, and the transaction card together as a single piece. Areas within the footprint of the perimeter frame other than the plurality of parts, the transaction card, and the plurality of sprues remain substantially open and free of material.

1 Claim, 14 Drawing Sheets

(56) References Cited

U.S. PATENT DOCUMENTS

| | | | | |
|---|---|---|---|---|
| 2,366,652 | A | 1/1945 | Rieger | |
| 2,920,682 | A | 1/1960 | Lindberg | |
| 3,581,432 | A | 6/1971 | Bass et al. | |
| 3,818,630 | A | 6/1974 | May | |
| D250,726 | S | 1/1979 | Venditti | |
| D250,786 | S | 1/1979 | Venditti | |
| 4,301,614 | A | 11/1981 | Newton | |
| D265,918 | S | 8/1982 | Schoch | |
| 4,959,035 | A | 9/1990 | Murasaki | |
| 5,549,215 | A * | 8/1996 | Cruce | B29C 45/2628 206/516 |
| 5,603,408 | A * | 2/1997 | Protz, Jr. | B65D 75/36 206/461 |
| 5,816,408 | A * | 10/1998 | Indelicato | A45D 31/00 206/470 |
| 6,478,650 | B1 | 11/2002 | Tsai | |
| 6,575,803 | B1 | 6/2003 | Liu | |
| 6,893,319 | B1 * | 5/2005 | Ohba | A63H 9/00 446/373 |
| 7,883,004 | B2 | 2/2011 | Halbur et al. | |
| 7,980,930 | B2 * | 7/2011 | Moreno | A63F 13/12 273/429 |
| 8,024,876 | B2 | 9/2011 | Bettin, Jr. | |
| 2003/0054724 | A1 * | 3/2003 | Tomas | A63H 27/008 446/35 |
| 2004/0094610 | A1 | 5/2004 | Longo | |
| 2010/0051705 | A1 | 3/2010 | Albers et al. | |
| 2010/0186270 | A1 | 7/2010 | Bettin, Jr. | |
| 2011/0250819 | A1 | 10/2011 | Tashman | |
| 2012/0012491 | A1 * | 1/2012 | Wade | B31B 1/00 206/461 |
| 2012/0130892 | A1 | 5/2012 | Ronayne | |
| 2012/0139727 | A1 | 6/2012 | Houvener et al. | |
| 2012/0152790 | A1 | 6/2012 | Houvener et al. | |
| 2012/0292206 | A1 * | 11/2012 | Casella | A45C 11/182 206/232 |

OTHER PUBLICATIONS

"Hello Kitty Model Kit," publicly available from www.like.cool.com/Hello_Kitty_Kit--Toy--Gear.htnnl, Jun. 8, 2010 (4 pages).

"Snap-A-Party," www.seefred.com/snap_a_party.htm, publicly available at least as early as Jul. 23, 2012 (2 pages).

Gianatasio, David, "Target Gift Card Converts Into a Small Model Airplane," www.adweek.com/adfreak/target-gift-card-converts-small-model-airplane-136540, Nov. 15, 2011 (5 pages).

Wade, Will, "First Data Sees Sticker Device as Mobile-Pay Bridge," www.americanbanker.com/issues/173_167/-360520-1.html, Aug. 25, 2008 (2 pages).

"Contactless Payments: Consumer Trends and Usage Preferences," www.firstdata.com, 2008 (2 pages).

First Data, "Go-Tag Solution," http://www.firstdata.com, 2008, (2 pages).

Office Action from Canadian Patent Application No. 2,838,142, mailed Aug. 13, 2014 (4 pages).

Office Action from Canadian Patent Application No. 2,838,142, mailed Apr. 1, 2014 (3 pages).

"Cavalier and 28mm Plastics," by Leofwine Wargamerson, http://leofwinewargamerson.blogspot.ca/2012_03_01_archive.html, Mar. 13, 2012 (13 pages).

"Wargames Factory Viking Bondi-unboxing, review and sprue inspection," by JC, http://wolvesonthetide.blogspot.ca/2012_07_01_archive.html, Jul. 26, 2012 (30 pages).

"Wargames Factory plastic 28mm Saxon Thegns unboxing," by The Old Giant, http://not2oldwargame.wordpress.com/2012/09/28/wargames-factory-plastic-28mm-saxon-thegns-unboxing, Sep. 28, 2012 (3 pages).

"More Sprue Shots," by Mark Mondragon, https://www.kickstarter.com/projects/dreamforge-games/something-wicked-this-way-comes-crusader-plastic-m/posts/344405, Nov. 7, 2012 (16 pages).

Office Action from Canadian Patent Application No. 2,838,142, mailed Dec. 19, 2014 (5 pages).

* cited by examiner

TRANSACTION PRODUCT ASSEMBLY WITH SEPARABLE PARTS FOR REASSEMBLY

CROSS-REFERENCE TO RELATED APPLICATION

This application is a continuation/divisional of and claims priority to U.S. Patent Application No. 61/747,245, filed Dec. 29, 2012, which is incorporated herein by reference.

BACKGROUND OF THE INVENTION

Stored-value cards and other transaction cards come in many forms. A gift card, for example, is a type of stored-value card that includes a pre-loaded or selectively loaded monetary value. In one example, a consumer buys a gift card having a specified value for presentation as a gift to another person. In another example, a consumer is offered a gift card as an incentive to make a purchase. A gift card, like other stored-value cards, can be "recharged" or "reloaded" at the direction of the bearer. The balance associated with the gift card declines as the gift card is used, thereby encouraging repeat visits to the retailer or other provider issuing the gift card to utilize any balance remaining on the gift card. Additionally, the gift card generally remains in the user's purse or wallet, serving as an advertisement or reminder to revisit the associated retailer. Gift cards and other transaction cards provide a number of advantages to both the consumer and the retailer.

SUMMARY

One aspect of the present invention relates to a transaction product assembly including a perimeter frame defining a footprint, a plurality of parts maintained within the footprint of the perimeter frame, a transaction card, and a plurality of sprues. The transaction card includes a machine-readable account identifier linking the transaction card to an account or record, wherein the transaction card is maintained within the footprint of the perimeter frame. The plurality of sprues extend between the perimeter frame, the plurality of parts, and the transaction card to hold perimeter frame, the plurality of parts, and the transaction card together as a single piece. Areas within the footprint of the perimeter frame other than the plurality of parts, the transaction card, and the plurality of sprues remain substantially open and free of material. Related assemblies, transaction cards, packaging, and associated methods are also disclosed herein.

BRIEF DESCRIPTION OF THE DRAWINGS

Embodiments of the invention will be described with respect to the figures, in which like reference numerals denote like elements, and in which.

DETAILED DESCRIPTION

A gift card assembly or other transaction product assembly is adapted for making purchases of goods and/or services from e.g., a retail store or website. According to one embodiment, an original consumer buys the transaction product assembly to give a recipient who in turn is able to use the transaction product assembly or at least a portion thereof at a retail store or setting to pay for goods and/or services. The transaction product assembly, according to embodiments of the present invention, provides the consumer and recipient with extra functionality in addition to the ability to pay for goods and/or services with at least the portion of the transaction product assembly. In particular, the transaction product assembly presents the original consumer and/or other bearer of the transaction product assembly with parts that are initially formed with one another, are readily separable from one another, and are able to be reconfigured with one another to form a new or secondary amusing object or assembly. In one embodiment, the parts are formed as one, two, or more injection molded pieces, connected by sprues integral sprues, and all bound by and coupled to a perimeter frame. The plurality of parts of each parts member are readily separated from one another, for example by ones own hands without the use of tools, by breaking the connecting sprues to remove the parts from each other, the sprues, and the frames. The parts reassemble another, for example by ones own hands without the use of tools, into a three-dimensional object, such as a toy, model, etc. providing an entertaining assembly allowing the bearer to create something from the mix of parts.

In one example, a transaction card is integrally included in one of the integral single piece, injection molded members including the frame, parts, and sprues and is coupled to the parts and frames by additional sprues. Transaction card includes an account identifier linked to a transactional account such that the transaction card is useful as payment toward goods and/or services. Inclusion of the transaction card makes the overall transaction product assembly a great gift option providing a recipient with not only a gift card, but additionally, an entertaining building apparatus.

Figure 1:
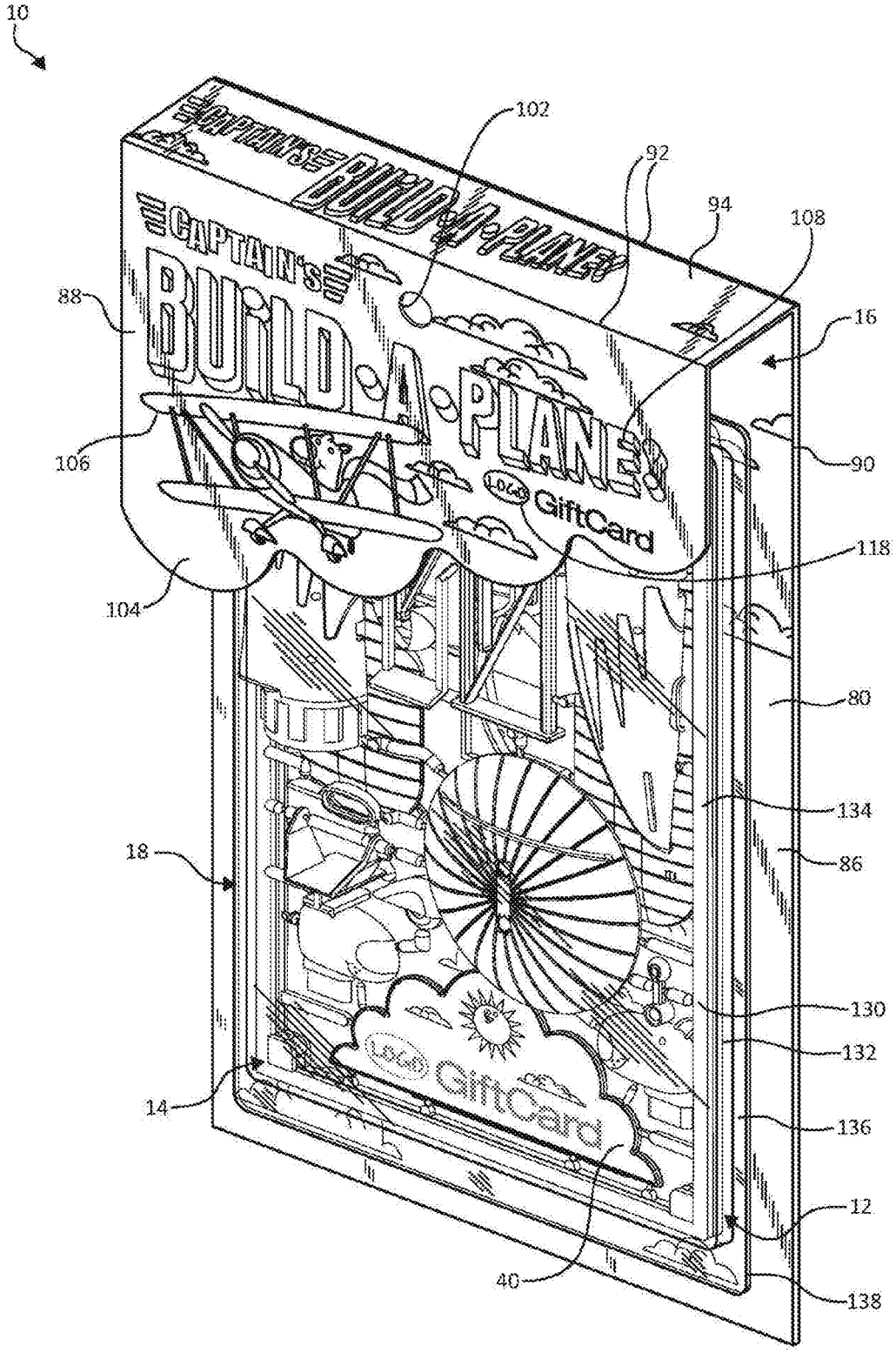
FIG. 1 is a front, perspective view illustration of a transaction product assembly, according to one embodiment of the present invention.
Figure 2:
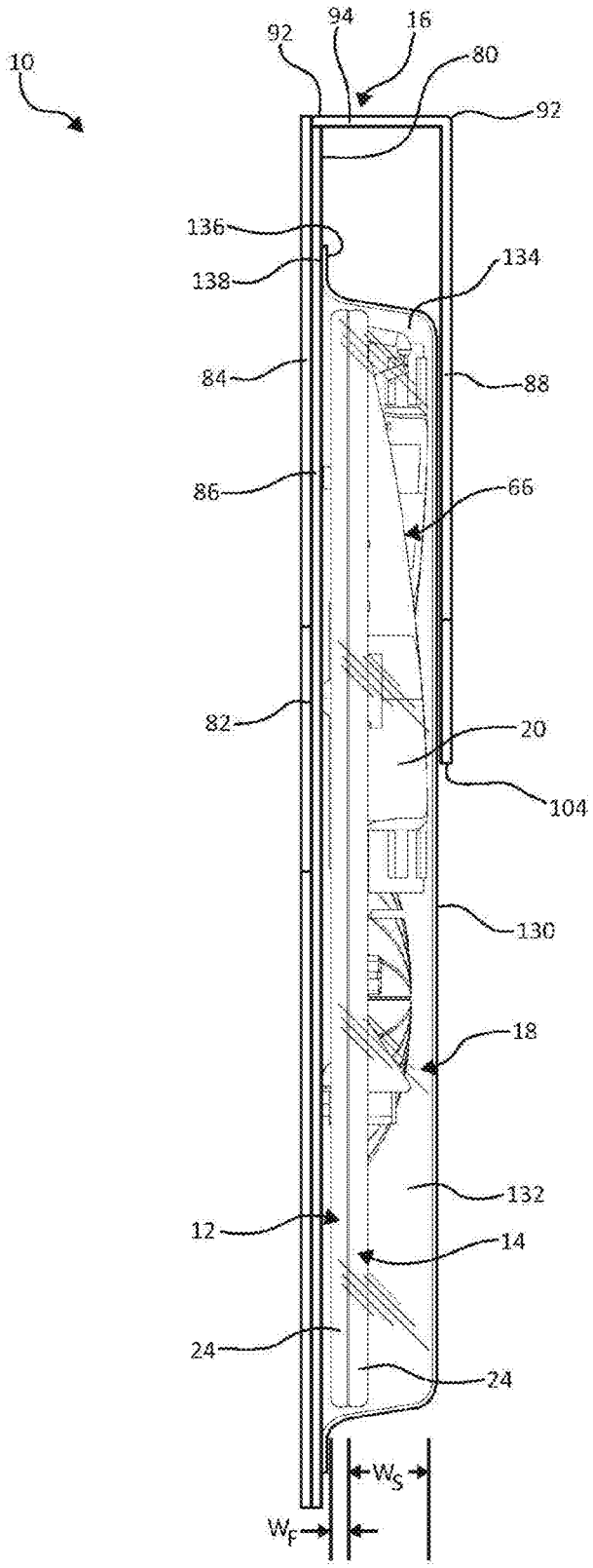
FIG. 2 is a left side view illustration of the transaction product assembly of FIG. 1, according to one embodiment of the present invention.
Figure 3:
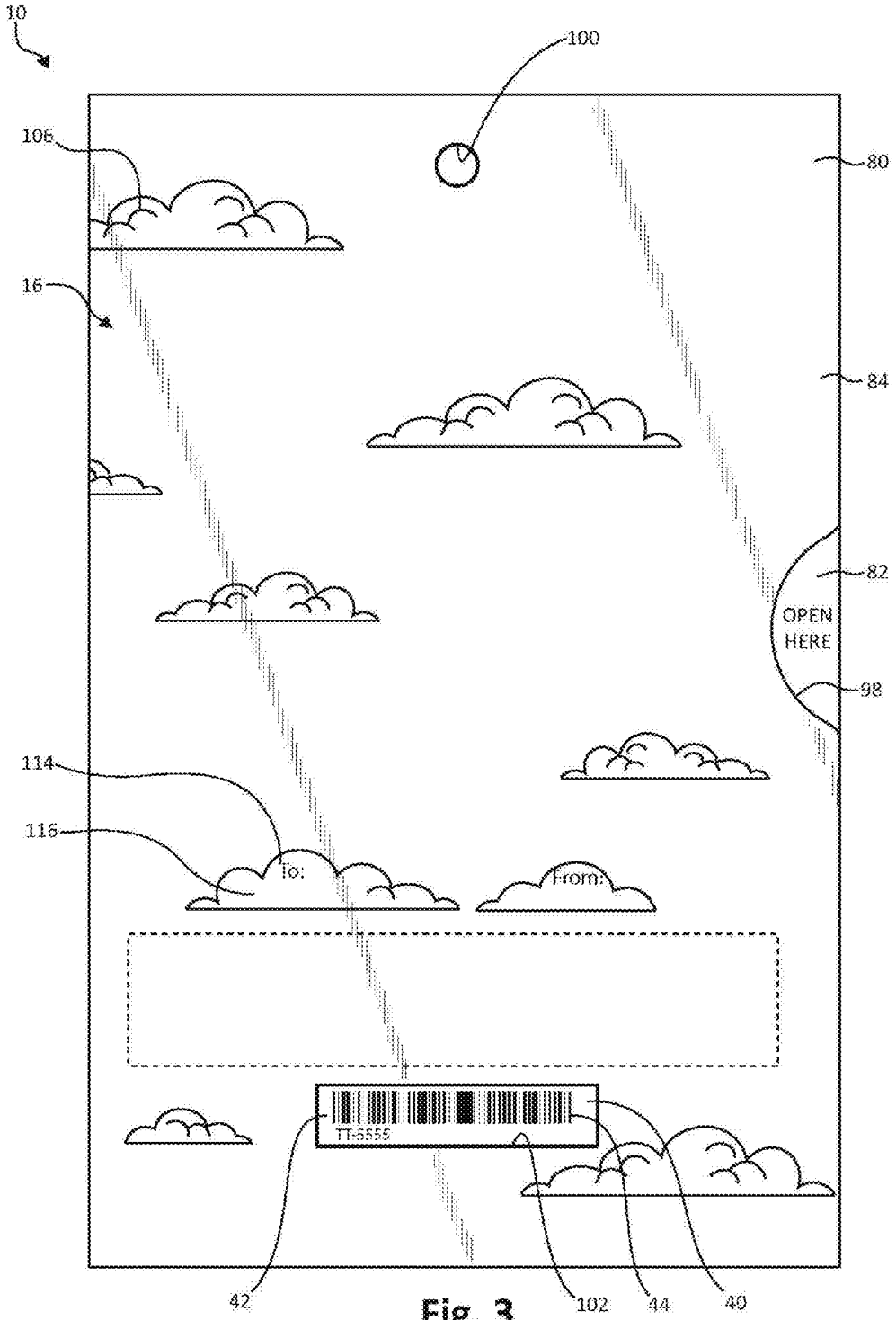
FIG. 3 is a rear view illustration of the transaction product assembly of FIG. 1, according to one embodiment of the present invention.
Figure 4:
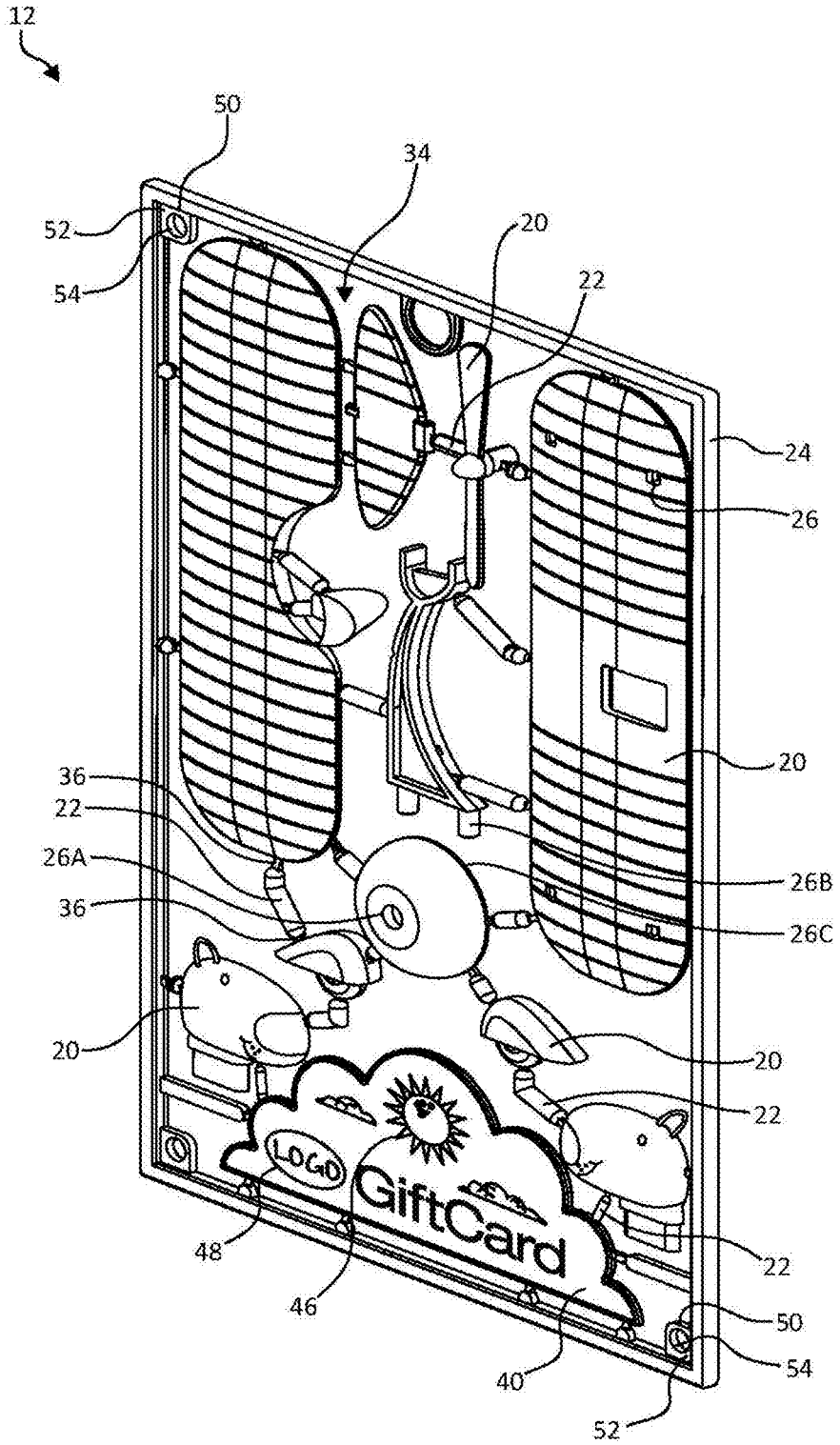
FIG. 4 is a front, perspective view illustration of a first parts member of the transaction product assembly of FIG. 1 including a transaction card, according to one embodiment of the present invention.

More specifically, referring to FIGS. 1-3, in one example, a transaction product assembly 10 includes a first parts member 12, a second parts member 14, a backer 16, and a clamshell member 18. Each of first parts member 12 and second parts member 14 are formed as a single injection molded piece and defines a plurality of parts 20 connected by sprues 22 all bound by and coupled to a perimeter frame 24 as shown with additional reference to FIGS. 4-7. Areas of first parts member 12 and second parts member 14 between plurality of parts 20 and sprues 22 generally remain open and free of material except as otherwise noted herein. Plurality of parts 20 of each first parts member 12 and second parts member 14 are readily separated from one another, for example by ones own hands without the use of tools, by breaking connecting sprues 22. Although primarily described herein as being two parts members, that is first parts member 12 and second parts member 14, in one embodiment, either only one or more than two parts members may be included in other transaction product assembly 10.

The plurality of parts 20 are each two or three-dimensional pieces having various coupling features 26 such as cavities 26A, pegs 26B, stepped edges 26C, alignment components 26D, etc. that each mate with corresponding coupling features 26 of other ones of the plurality of parts 20 in order to be reassembled into a three-dimensional object. For example, in the illustrated embodiment, the plurality of parts 20 are configured to be reassembled into an airplane 28 with a pilot 30, a stand 32, and a base 33 for holding the airplane and pilot (see FIG. 12). Accordingly, each of the plurality of parts 20 defines all or part of an airplane chassis, wings, propeller, fin, nose, wheel, pilot head, wing framework, stand, etc.

First parts member 12, according to one embodiment of the invention, includes a substantially rectangular perimeter frame 24, for example, in the form of a single, outer perimeter, closed loop. Other closed loop shapes for perimeter frame 24 are also contemplated. A first portion 34 of the plurality of parts 20 is placed within perimeter frame 24 in a single layer in a roughly planar arrangement. One of sprues 22 extends between outer perimeters of two of the plurality of parts 20 or one of the plurality of parts and perimeter frame 24 to hold first parts member 12 together as a single injection molded piece. In one example, sprues 22 are each formed in mold passages holding the various mold chambers (not shown) together and allowing the liquid material (e.g., polystyrene, polyvinyl chloride, polyethylene, or another plastic) to move from perimeter frame 24 to each of the plurality of parts 20 and, in one instance, back to perimeter frame 24 during the injection molding process.

Each sprue 22 includes a runner 36 at one or both ends thereof that is a smaller diameter or otherwise is a thinner plastic that a remainder of the corresponding sprue 22, in one embodiment. The small thickness of each runner 36 allows runners 36 to be manipulated and broken using only a bearer's hands (e.g., pulled or twisted) to separate the plurality of parts 20 and perimeter frame 24 from one another. In one example, while first portion 34 of the plurality of parts can be pulled apart by a user's hand, a user may wish to trim any remaining runners 36 left on any of first portion 34 of the plurality of parts 20 with a scissors or other sharp edged tool to provide a cleaner overall appearance to each of the plurality of parts 20.

In one example, one of first parts member 12 and second parts member 14 (first parts member as illustrated in FIGS. 1-8) additionally includes a transaction card 40 having at least one substantially planar surface 42 supporting an account identifier 44. In this manner, transaction card 40 is offered as an integrated piece with the plurality of parts 20 contributing to the cohesiveness of overall transaction product assembly 10. The account identifier links transaction card 40, and therefore, transaction product assembly 10, to an account and/or record of the monetary or other value balance associated with the transaction product assembly by providing identification of the associated account and/or record as machine-readable by a point-of-sale terminal. In one example, account identifier 44 includes one or more of a bar code, magnetic strip, a smart chip or other electronic device, a radio frequency identification (RFID) device or other suitable identifier readily machine readable by a point-of-sale terminal or other account access station or kiosk.

The account or record of the monetary or other balance of transaction card 40 optionally is maintained on a database, other electronic or manual record-keeping system or, in the case of "smart" cards for example, on a chip or other electronic device(s) on transaction card 40 itself. Accordingly, by scanning account identifier 44, the account or record linked to transaction card 40 is identified and can subsequently be activated, have amounts debited therefrom and/or have amounts added thereto. While primarily described as being included on transaction card 40, in other embodiments, account identifier 44 is otherwise located on transaction product assembly 10, for example, on one of the plurality of parts 20 making up part of the final assembly of parts. In one embodiment, transaction card 40 is eliminated. In one example, transaction card 40 is included coupled directly to perimeter frame 24 by corresponding sprues 22.

In one embodiment, first parts member 12 includes indicia such as decorative indicia 46, brand indicia 48, and redemption indicia 49. As illustrated, each of decorative indicia 46, brand indicia 48, and redemption indicia 49 are shown as being included on transaction card 40; however, in one example, one or more of decorative indicia 46, brand indicia 48, and redemption indicia 49 are also included on other portions of first parts member 12. Decorative indicia 46 provides aesthetically pleasing graphics including one or more object and/or text making transaction card 40 or other portion of first parts member 12 more appealing, more realistic looking, more visually linked to backer 16, etc. Brand indicia 48 identify a brand associated with transaction product assembly 10 such as identifying a product brand, a store brand, a department, etc.

Figure 5:
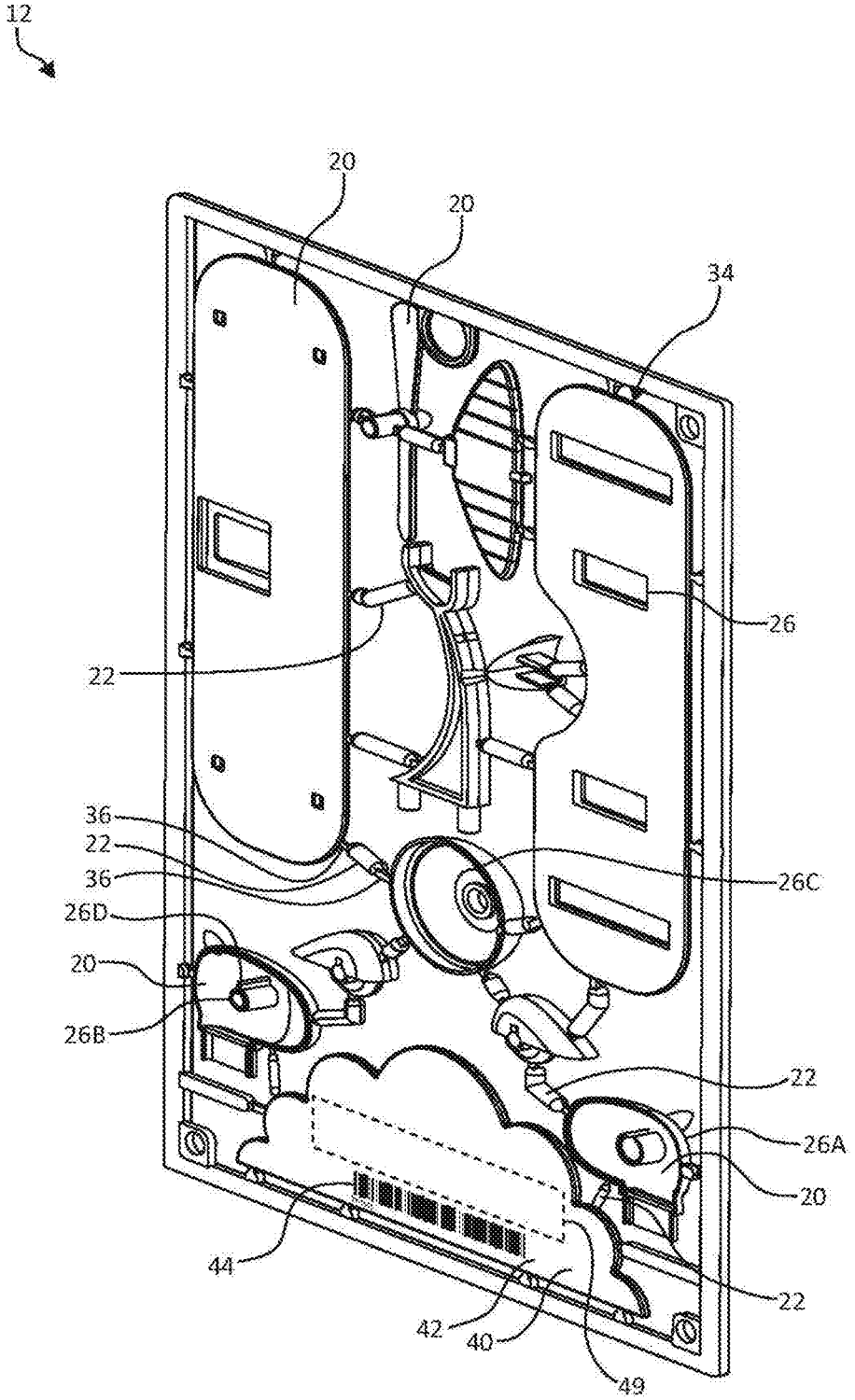
FIG. 5 a rear, perspective view illustration of the first parts member of FIG. 4, according to one embodiment of the present invention.
Figure 12:
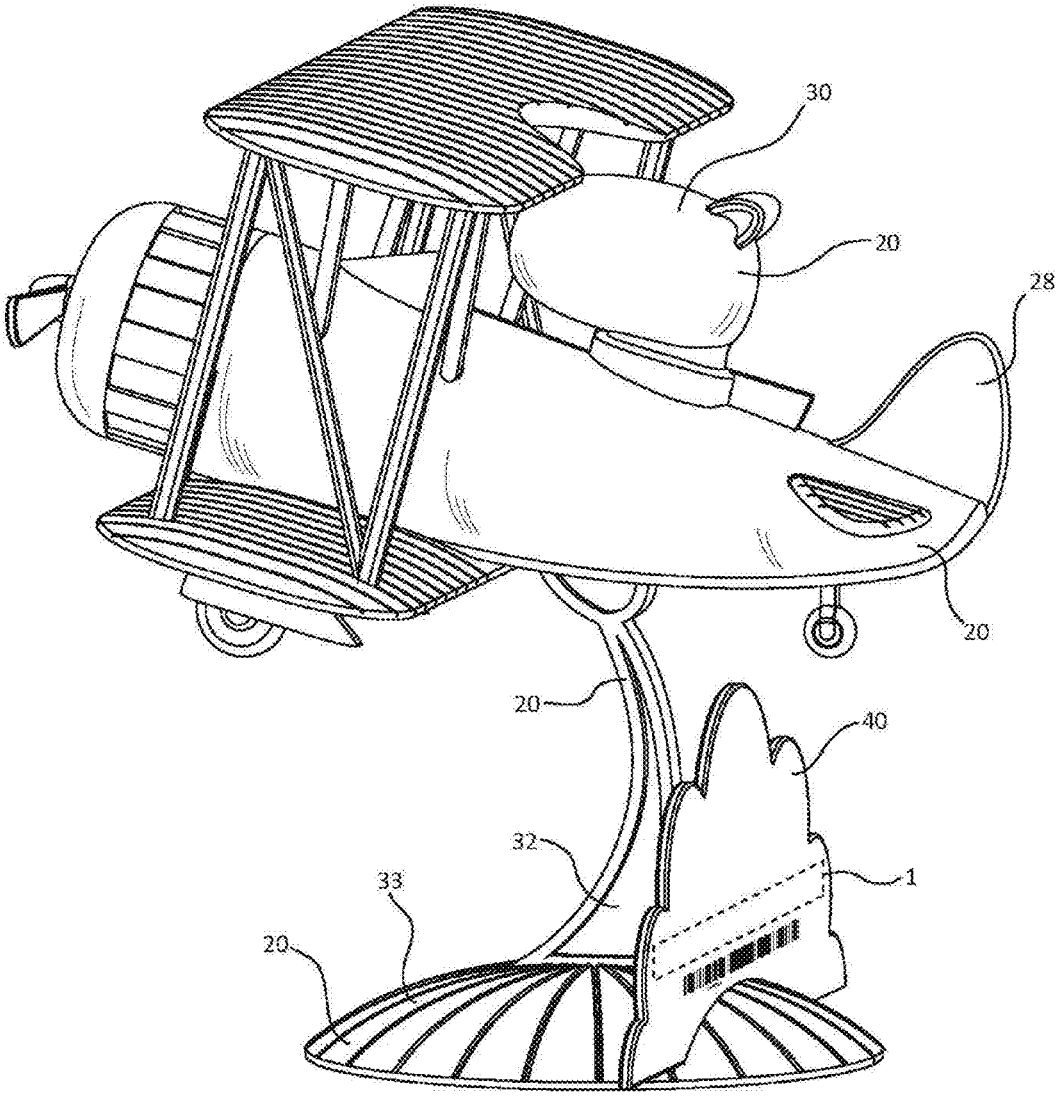
FIG. 12 is a front, perspective view illustration an object formed from reassembly of pieces of the first parts member and the second parts member of FIG. 8, according to one embodiment of the present invention.

Redemption indicia 49, which are generally indicated with a dashed line box in FIGS. 5 and 12, inform a bearer of transaction product assembly 10 or of just transaction card 40 that transaction card 40 is redeemable for the purchase or use of goods and/or services and that upon use, a value of the purchased goods and/or services will be deducted from the financial account or record linked to transaction card 40. In one embodiment, redemption indicia 49 include phrases such as "<NAME OF STORE> GiftCard" and "This GiftCard is redeemable for merchandise or services at any of our stores or at our website," and/or provides help or phone line information in case of a lost, stolen or damaged transaction card 40, etc.

In one embodiment, first parts member 12 further defines coupling components 50 configured to facilitate selectively coupling first parts member 12 with second parts member 14, e.g., corner coupling component 50, including primary body 52 with mating feature 54 (hole or protrusion).

Figure 6:
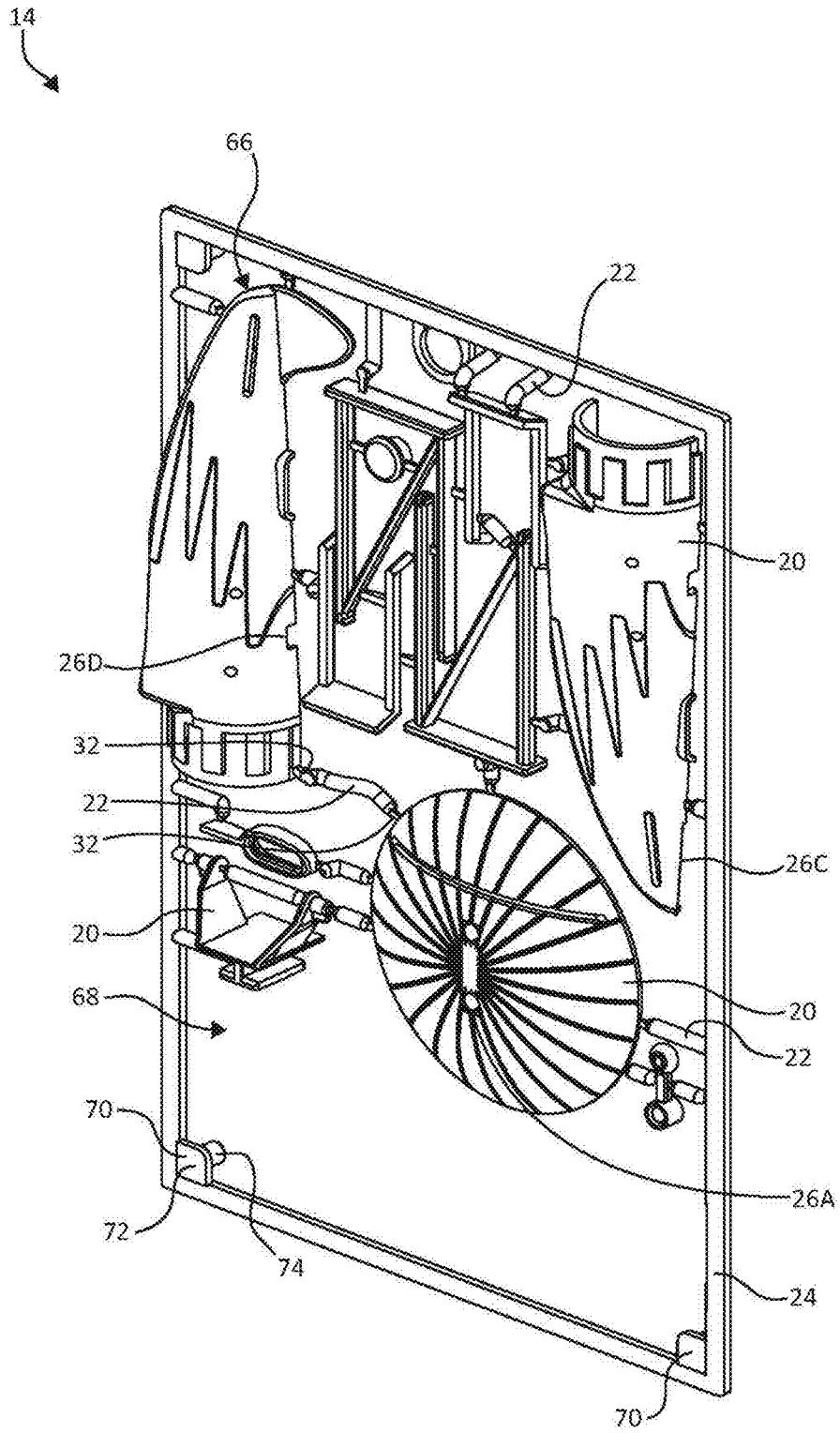
FIG. 6 is a front, perspective view illustration of a second parts member of the transaction product assembly of FIG. 1, according to one embodiment of the present invention.
Figure 7:
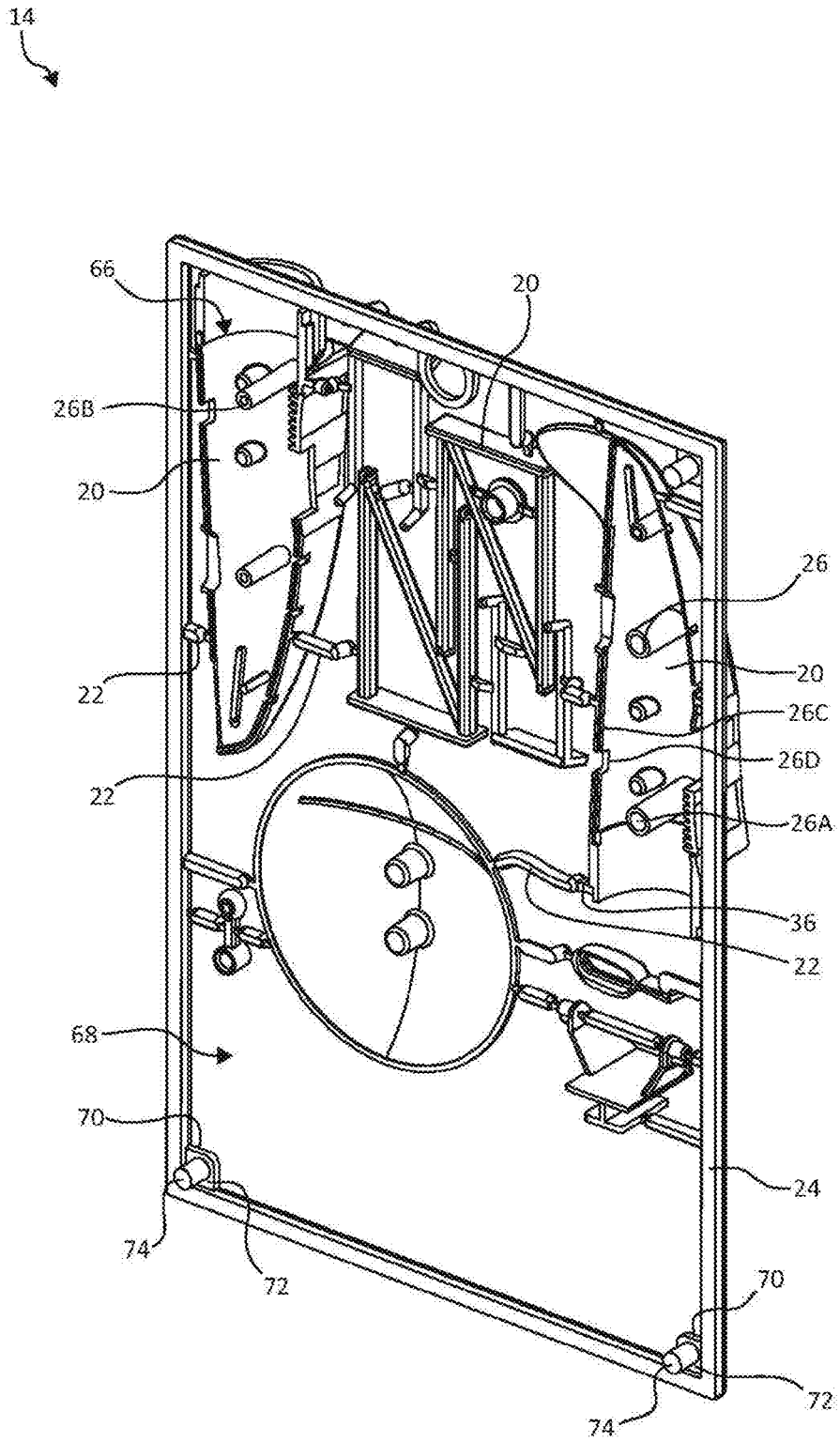
FIG. 7 a rear, perspective view illustration of the second parts member of FIG. 6, according to one embodiment of the present invention.

Referring to FIGS. 6 and 7, second parts member 14, like first parts member 12 and, according to one embodiment of the invention, includes a substantially rectangular, perimeter frame 24, for example, in the form of a single, outer perimeter, closed loop. Other closed loop shapes for perimeter frame 64 are also contemplated. A second portion 66 of the plurality of parts 20 is placed within perimeter frame 64 in a single layer in a roughly planar arrangement. One of sprues 22 with one or more runners 24 extends between outer perimeters of two of second portion 66 of the plurality of parts 20 or one of the plurality of parts 20 and perimeter frame 64 to hold second parts member 14 together as a single injection molded piece.

In one example, second portion 66 of the plurality of parts 20 are arranged so as to define an extended void 68 within the overall footprint of perimeter frame 24. More specifically, in one embodiment, extended void 68 is sized and shaped to allow transaction card 40 of first parts member 12 to be seen through second parts member 14 via extended void 68. Accordingly, second parts member 14 allows viewing of transaction card 40 through a frontmost positioned second parts member 14 for viewing during retail sale and/or by a gift recipient. Where the stacking of first parts member 12 and second parts member 14 is reversed, extended void 68 allows visual and computer optical access to account identifier 44 through second parts member 14, according to one embodiment. In one example, extended void is larger in all directions than transaction card 40 as a whole such that a substantial entirety of transaction card 40 is readily viewable through extended void 68 of second parts member 14. While primarily described herein as first portion 36 of the plurality of parts 20 and second portion 66 of the plurality of parts 20, first portion 36 may alternatively be referred to as a plurality of parts and second portion 66 as an additional or second plurality of parts.

Figure 8:
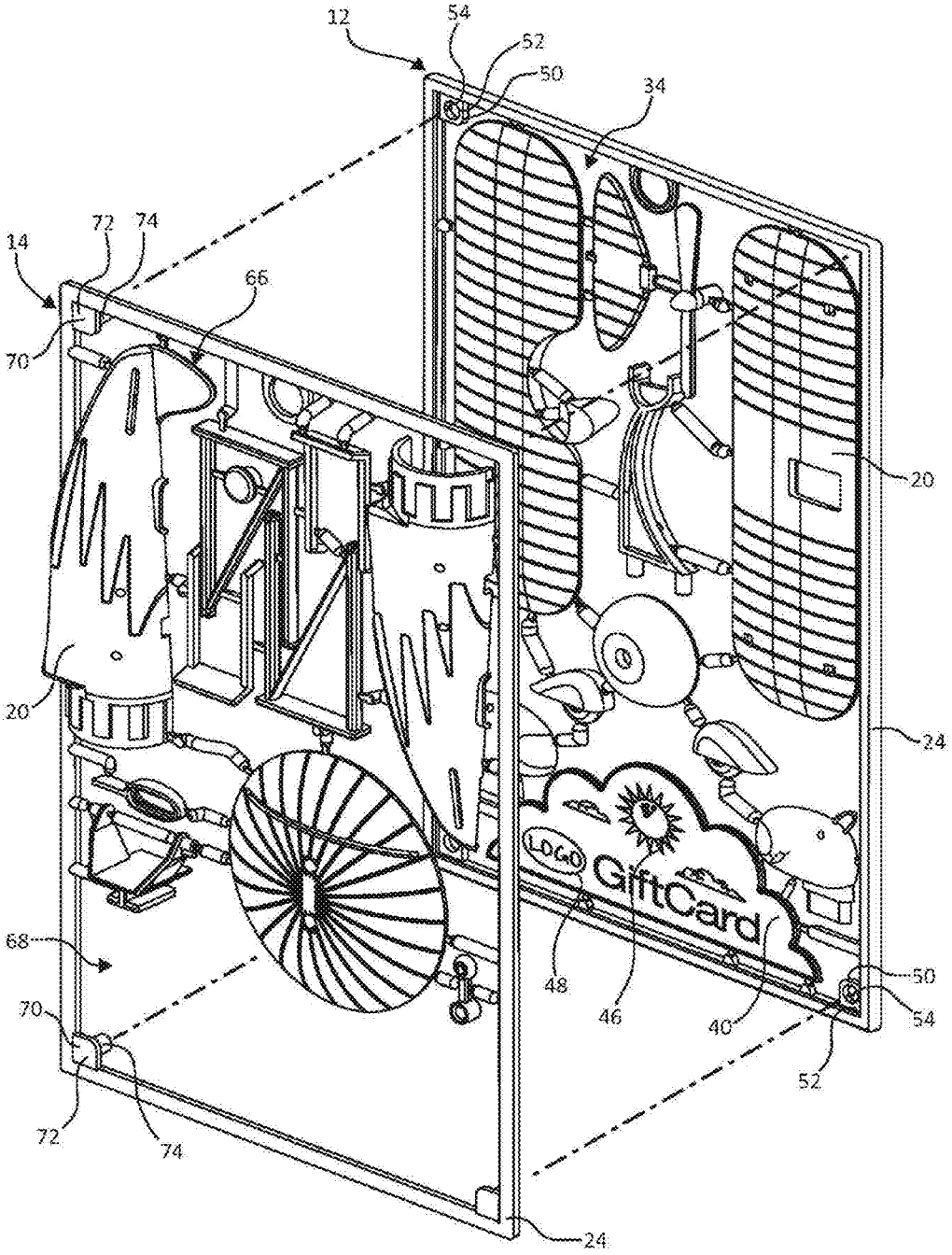
FIG. 8 is a front, exploded perspective view illustration of parts assembly including the first parts member of FIG. 4 and the second parts member of FIG. 6, according to one embodiment of the present invention.

In one embodiment, second parts member 14 further defines coupling components 70 configured to facilitate selectively coupling first parts member 12 with second parts member 14, e.g., corner coupling component, including primary body or corner web 72 with mating feature 74 in the form of a hole or protrusion (e.g., a protrusion as illustrated in FIGS. 6-8). As shown in the illustrated embodiments, more particularly, second parts member 14 defines protrusions mating features 74 each for being selectively received and maintained by a corresponding aperture mating feature 54 of first parts member 12 as shown in FIG. 8 for example.

FIG. 8, more particularly, illustrates selective coupling of first parts member 12 and second parts member 14 using coupling components 50 and 70 in a manner allowing transaction card 40 to be substantially entirely viewed through extended void 68 of first parts member 12. For instance, coupling components 50 and 70 snap together selectively maintaining first parts member 12 immediately adjacent second parts member 14. Additionally referring to FIG. 2, in one embodiment, when first parts member 12 and second parts member 14 are coupled to one another, perimeter frame 24 of first parts member 12 is posited immediately adjacent and in alignment with second parts member 14 such that first parts member 12 and second parts member 14 share substantially the same overall footprint, at least in examples where first parts member 12 and second parts member 14 are formed to have substantially identically sized and shaped perimeter frames 24.

In one example, second portion 66 of the plurality of parts 20 are substantially thinner ones of the plurality of parts 20 having a thickness less than the corresponding perimeter frame 24 or such that any additional thickness corresponds with voids of second parts member 14 such that when stacked first parts member 12 and second parts member 14 can be positioned immediately adjacent to one other with perimeter frames 24 contacting one another a illustrated in FIG. 2. In one embodiment, ones of the plurality of parts members 20 included in second portion 66 include thicker ones of the plurality of parts 20 including surface curvatures or protrusions extending considerably away from perimeter frame in a first direction while not extending beyond a thickness of perimeter frame 24 in the second, opposite direction. For example, as illustrated in FIG. 2, as a results of this configuration, an overall width $W_F$ of first parts members is considerably smaller than an overall width $W_S$ of second parts member 14, with an overall assembly of first parts member 12 and second parts member 14 substantially equally a sum of the two overall widths $W_F$ and $W_S$.

Figure 9:
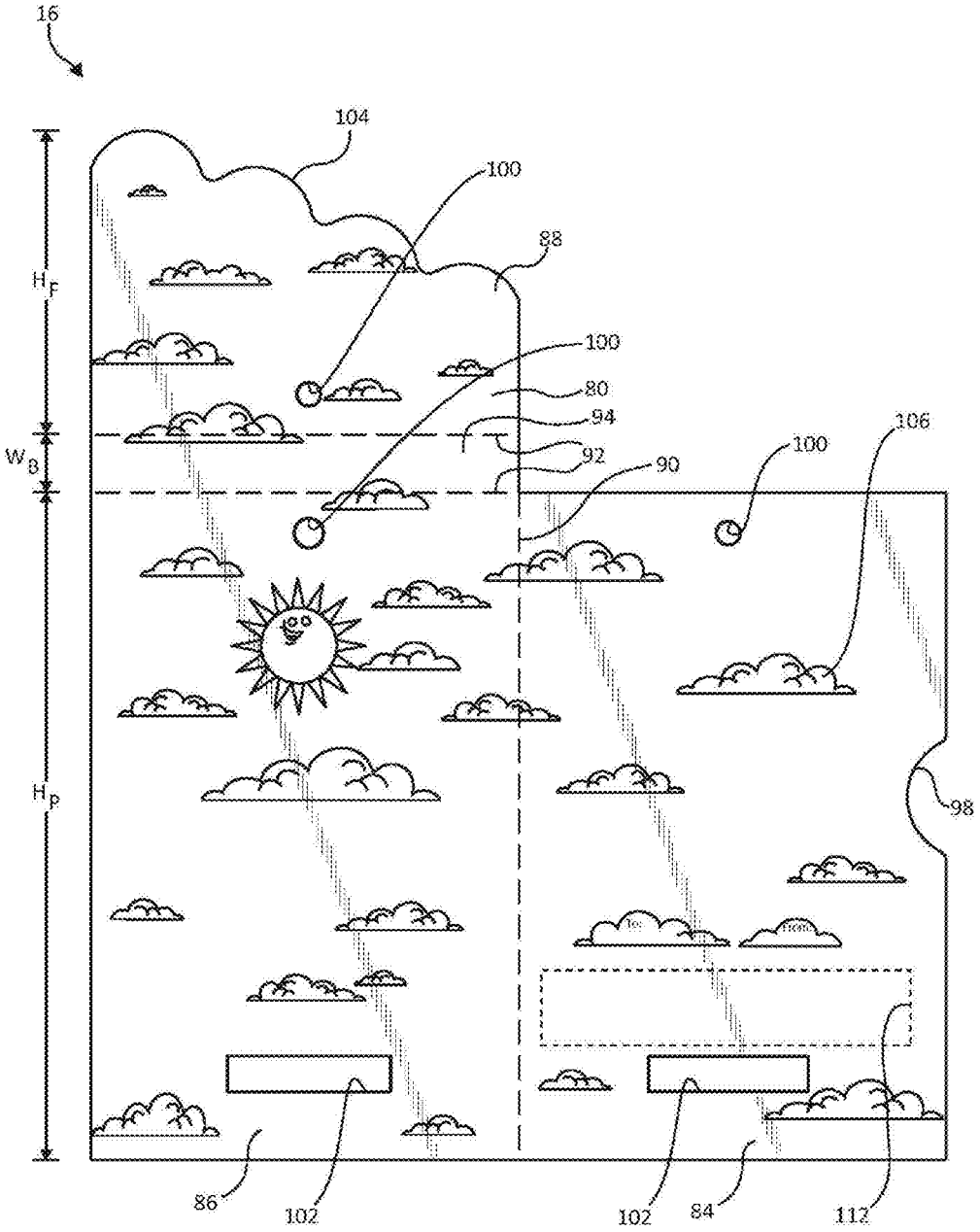
FIG. 9 is a front view illustration of the unfolded backer of the transaction product assembly of FIG. 1, according to one embodiment of the present invention.

Backer 16 is illustrated in its initial flattened (i.e., unfolded) position, according to one embodiment, in FIG. 9. Backer 16 is substantially planar and formed as a single member, as shown, including a first or front surface 80 and a second or rear surface 82 opposite front surface 80. Backer 16 is divided to form a rear section or rear panel 84, a front section or front panel 86, and a third section or front flap 88, and a top section or top panel 94. More particularly, overall outer perimeter edges 96 of backer 16 define an overall size and shape of backer 16, and a fold line 90 and a pair of fold lines 92 divide backer 16 into rear panel 84, front panel 86, front flap 88, and top panel 94. Fold line 90 longitudinally extends along an overall end backer height $H_P$ (or height of panels, that is rear panel 84 and front panel 86) dividing rear panel 84 and front panel 86 from one another. Pair of fold lines 92 extend in a direction substantially perpendicular to fold line 90, with one fold line of the pair of fold lines 92 extends across a top of rear panel 84 with the other one of the pair of fold lines 92 extending parallel thereto, in one example. Top panel 94 is defined between the pair of fold lines 92 to have a height that will become an overall width $W_B$ of backer 16. Front flap 88 extends from the other one of the pair of fold lines 92 away from rear panel 84 to have a flap height $H_F$. In one example, flap height $H_F$ is substantially less than backer height $H_P$, for example, is less than half of backer height $H_P$. Front flap 88 defines a flap free edge 104 opposite pair of folds 92 having a decorative or non-linear profile further contributing to the aesthetic appeal of backer 16 and, therefore, transaction product assembly 10.

Backer 16 defines other features, according to one embodiment, such as a finger access indenture 98 extending inwardly from a side portion of outer perimeter edge 96 along front rear panel 84. Each of rear panel 84, front panel 86, and front flap 88 define a hanging aperture 100 in positions configured to longitudinally align upon final assembly and folding of backer 16 such that a single support rod or other structure can extend through all hanging apertures 100 allowing the support structure to support backer 16 and any items attached thereto. In one example, rear panel 84 and front panel 86 each define an interior window 102 sized larger than account identifier 44 of transaction card 40 and configured to align with one another upon assembly of rear panel 84 and front panel 86, more particularly, folding of backer 16 about fold line 90.

Figure 10:
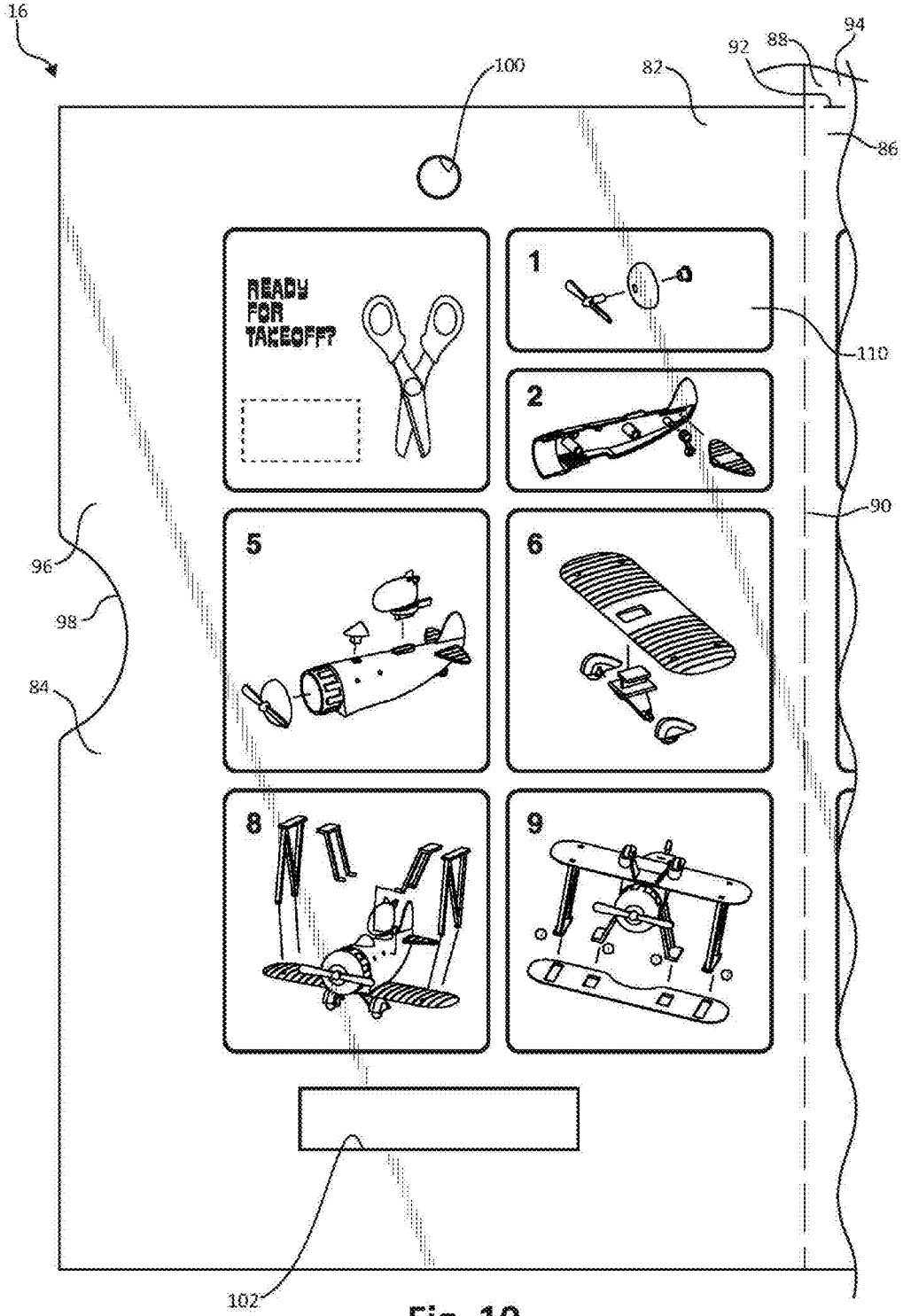
FIG. 10 is a first partial view illustration of the unfolded backer of FIG. 9, according to one embodiment of the present invention.
Figure 11:
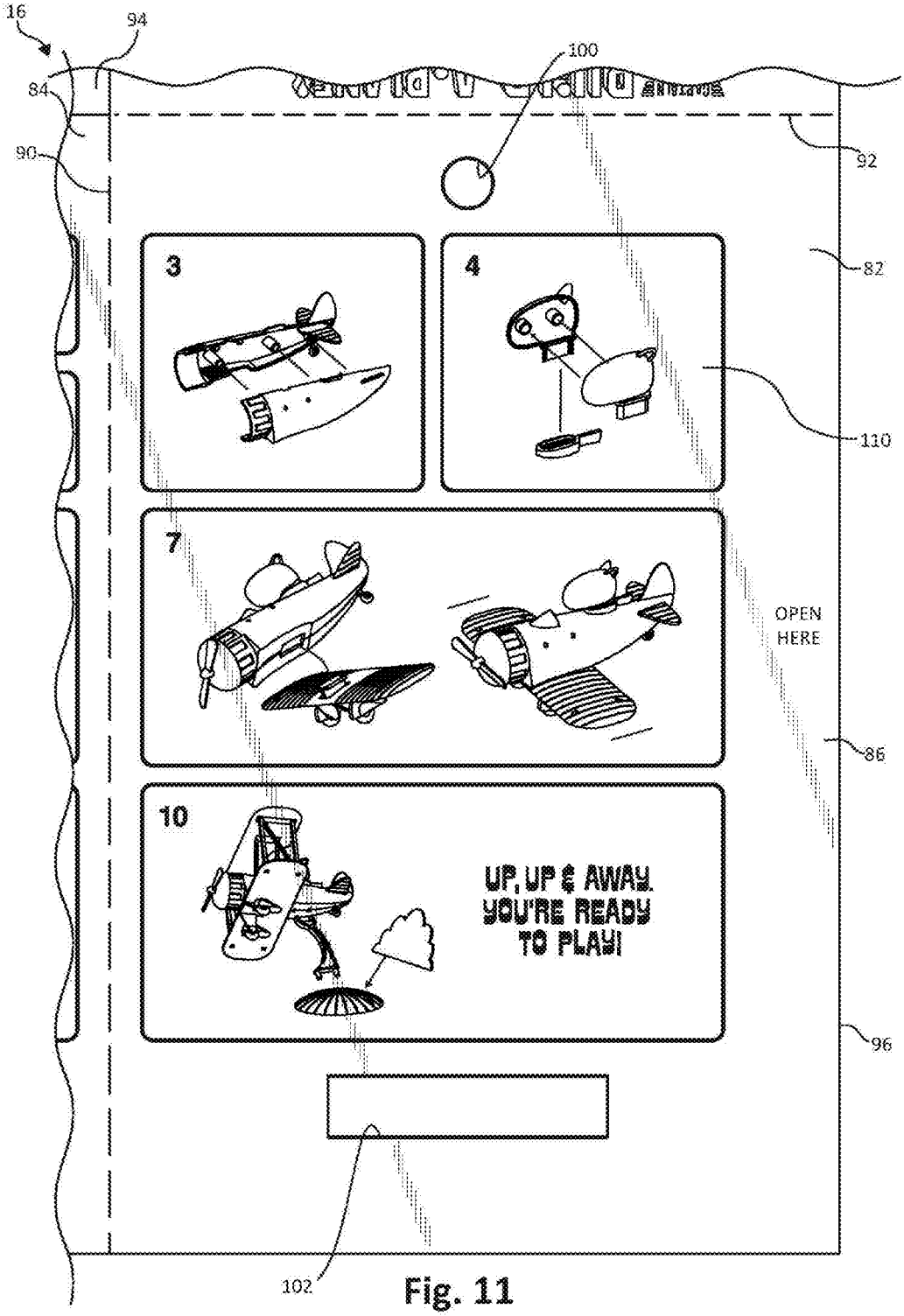
FIG. 11 is a second partial view illustration of the unfolded backer of FIG. 9, according to one embodiment of the present invention.

In one embodiment, backer 16 includes indicia such as decorative indicia 106, identifying indicia 108, instructional indicia 110, redemption indicia 112, message field indicia 114, and/or brand indicia 118. In one example, decorative indicia 286 relate to a particular occasion, such as a wedding, new baby, graduation, holiday, season, brand identifier, media format identifier, or other visual design to promote purchase of transaction product assembly 10 or otherwise relates to the non-transactional feature of transaction product assembly 10. In one example, decorative indicia 106 relate to any aesthetics or decorative indicia on one or more of the plurality of parts 20. Identifying indicia 108, as shown, for example, in FIG. 1 identify what is included in transaction product assembly 10, especially, the non-transactional portions of transaction product assembly 10. Instructional indicia 110 on rear surface 82 of backer 16, shown in enlarged detail in FIGS. 10 and 11, provide instructions regarding initial disassembly of the plurality of parts 20 from each other and perimeter frames 24, for example, by hand or using a scissors, and detailed instructions on reassembly of the plurality of parts 20 to form the three-dimensional object, character, etc. (e.g., a plane in the illustrated embodiment). For example, instructional indicia 110 pictorially and/or textually describe and order and a manner in which each of the plurality of parts 20 are re-assembled to form the three-dimensional end object.

In one embodiment, redemption indicia 112 are included on transaction product assembly 10, for example, on rear panel 84 of backer 16. Redemption indicia 112 indicate that transaction card 40 is redeemable for the purchase of goods and/or services and that, upon use, a value of the purchased goods and/or services will be deducted from the financial account or record linked to transaction product assembly. In one embodiment, redemption indicia 112 include phrases such as "<NAME OF STORE> GiftCard" and "This GiftCard is redeemable for merchandise or services at any of our stores or at our web site," and/or provides help or phone line information in case of a lost, stolen or damaged stored-value card, etc. In one example, redemption indicia 112 are substantially identical to redemption indicia 49 on transaction card 40.

Referring to FIG. 3, message field indicia 114, for example, include one or more "to," "from," "amount" and "message" fields, and are configured to be written to by the bearer of transaction product assembly 10 prior to presenting transaction product assembly 10 to a recipient. Message fields 116 providing spaces for a bearer to write information on backer 16 corresponding with message field indicia 114, such as who transaction product assembly 10 is being gifted to, who transaction product assembly 10 is being given by, an amount or value loaded to transaction card 40. As such, message field indicia 114 facilitate the consumer in preparing transaction product assembly 10 for presentation to a recipient. Brand indicia 118 identify a brand associated with transaction product assembly 10 such as identifying a product brand, a store brand, department, etc. In one example, brand indicia identify a store or location configured to accept transaction product assembly 10 as payment toward a purchase of goods and/or services. Any other indicia such as decorative indicia may also be included on backer 150. In one embodiment, one or more of decorative indicia 106, identifying indicia 108, instructional indicia 110, redemption indicia 112, message field indicia 114, and/or brand indicia 118 are eliminated form backer 16.

Clamshell member 18 is vacuum formed or otherwise suitably formed to be transparent or translucent (e.g., substantially transparent) and includes a primary panel 130 and sidewalls 132 extending around and rearwardly from an outer perimeter of primary panel 130. As such, primary panel 130 and sidewalls 132 define a cavity 134. In one example, clamshell member 18 additionally includes a perimeter flange 136 extending from and radially outwardly from edges of sidewalls 132 opposite primary panel 130. Perimeter flange 136 extends substantially parallel to primary panel 130. Perimeter flange 136 defines a back surface 138 facing away from primary panel 130 for interfacing with backer 16. Clamshell member 18 is sized and shaped to fit in an overall footprint of front panel 86, and upon assembly, back surface 138 is adhered to or otherwise coupled with front surface 80 of front panel 86. As such, backer 16 and clamshell member 18 form packaging for first parts member 12, second parts member 14, and/or transaction card 40. Other packaging in addition to or as an alternative to backer 16 and clamshell member 18 is also contemplated and will be apparent to those of skill in the art upon reading this application.

Figure 13:
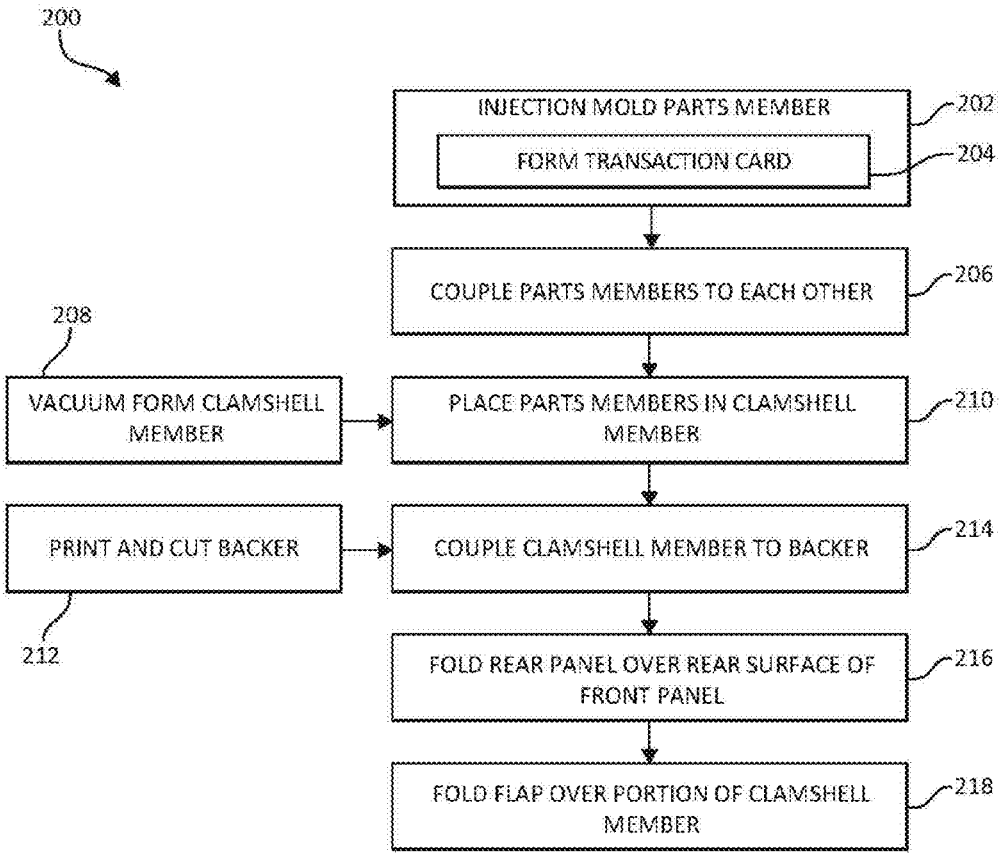
FIG. 13 is a flow chart illustrating a method of forming a transaction product assembly, according to one embodiment of the present invention.

FIG. 13 is a flow chart illustrating one embodiment of a method 200 of assembling transaction product assembly 156. At 202, first parts member 12 and second parts member 14 are injection molded of a suitable plastic, such as acrylonitrile butadiene styrene (ABS), polypropylene, or other suitable plastic, or any other suitable material, according to one embodiment of the invention. Each of first parts member 12 and second parts member 14 includes a portion of the plurality of parts 20 surrounded by perimeter frame 24 and coupled to one another and the perimeter frame 24 via sprues 22 as described in detail above. In one example, forming first parts member 12 and second parts member 14 includes forming transaction card 40, for instance, within perimeter frame 24 connected to perimeter frame 24 and/or others of the plurality of parts 20 via sprues 22. In another example, transaction card 40 is formed separately from first parts member 12 and second parts member 14. In one example, following injection molding of first parts member 12, a machine-readable account identifier 44 is printed or otherwise secured to transaction card 40 of first parts member 12.

At 206, first parts member 12 and second parts member 14 are coupled to one another. For example, protruding mating features 54 of first parts member 12 and protruding mating features 74 of second parts member 14 are snapped or otherwise selectively coupled to one another. In another embodiment, first parts member 12 and second parts member 14 are not coupled to one another before being placed in packaging. Upon coupling first parts member 12 and second parts member 14, in one example, transaction card 40 aligns with extended void 68 such that transaction card 40 of first parts member 12 is viewable through second parts member 14, more particularly, extended void 68 of second parts member 14 to be seen by potential consumers and/or gift recipients looking through primary panel 130 of clamshell member 18 (as will be further described below; and as can be see in FIG. 1).

At 208, clamshell member 18, as defined above, is formed via vacuum forming or other suitable technique to be transparent or translucent. Operation 208 may occur at any time before operation 210 including before, after, or at the same time as any of operations 202 and 206. Then, at 210, first parts member 12 and second parts member 14 are placed in cavity 134 of clamshell member 18. At 212, backer 16, as defined above, is printed and cut from paperboard, cardboard, or other suitable, substantially planar member. Operation 212 may occur at any time before operation 214 including before, after, or at the same time as any of operations 202, 206, 208, and 210. Then, at 214 clamshell member 18 with first parts member 12 and second parts member 14 within cavity 134 is coupled to backer 16. More particularly, back surface 138 of perimeter flange 136 is adhered or otherwise secured to front surface 80 of backer 16, for example, of front panel 86 of backer 16 as illustrated, for instance, in FIGS. 1-3. When so assembled, in one example, account identifier 44 of first parts member 12 aligns with window 102 of backer 16, for example, to be viewable, readable, and/or otherwise able to be scanned through one or both of front panel 86 and rear panel 84. Accordingly, in one embodiment, window 102 in backer 16 allows access to account identifier 44 to activate and/or load transaction card 40 without removing transaction card 40 from clamshell member 18 or backer 16. In one embodiment, where window 102 of backer 16 is eliminated, backer 16 is foldable or otherwise configured to provide access to account identifier 44 of transaction card 40 without removing transaction card 40 from backer 16.

At 216, rear panel 84 of backer 16 is folded about fold line 90 behind rear surface 82 of front panel 86 and is selectively secured thereto, for example, with an adhesive, hook and loop closure, etc. When so closed, apertures 100 of front panel 86 and rear panel 84 align with one another. While illustrated in FIG. 13 as occurring after clamshell member 18 is coupled to backer 16, in other embodiments, operation 216 may occur before operation 214. At 218, front flap 88 of is folded about pair of fold lines 92 such that top panel 94 extends forwardly, substantially perpendicularly to rear panel 84 and front flap 88 extends downwardly from top panel 94 in front of front panel 88 and clamshell member 18, for example, in a directly substantially parallel to front panel 86. As such, front flap 88 partially covers clamshell member 18 as well as first parts member 12 and second parts member 14 container therein contributing to the overall aesthetics of transaction product assembly 10. In one example, front flap provides area for brand, decorative, informational, or other indicia contributing to informing potential consumers about transaction card and the reassembly of the plurality of parts 20 and/or does not cover transaction card 40 of first parts member 12 as viewed through extended void 68 of second parts member 14. In one embodiment, front flap 88 is adhered or otherwise secured to primary panel 130 of clamshell member 18. Those of skill in the art will appreciate that other assemblies differing from those described above fall within the scope of the invention.

Figure 14:
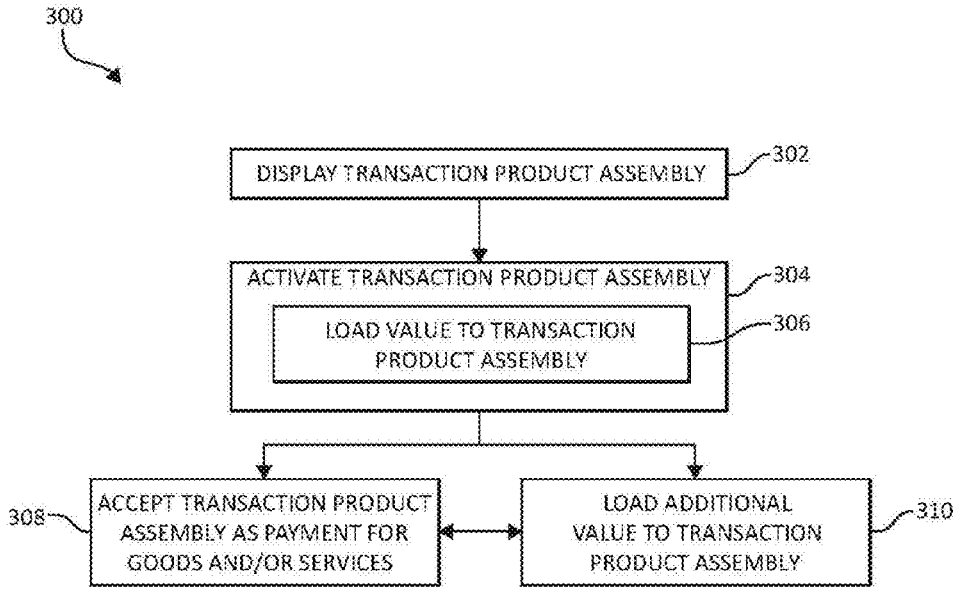
FIG. 14 is a flow chart illustrating a method of encouraging purchase and facilitating use of a transaction product, according to one embodiment of the present invention.

FIG. 14 is a flow chart illustrating one embodiment of a method 300 of encouraging purchase and facilitating use of transaction product assembly 10 by consumers and/or recipients. At 302, transaction product assembly 10 is placed on or hung from a rack, shelf or other similar device to display transaction product assembly 10 for sale to potential consumers. In one embodiment, a depiction of transaction product assembly 10 is placed on a web site for viewing and purchase by potential consumers.

At 304, a consumer who has decided to purchase transaction product assembly 10 presents transaction product assembly 10 with or without backer 16 to a retail store employee, retail store kiosk, remote terminal or other person or device to scan account identifier 44 to access an account or record linked to account identifier 44. In particular, account identifier 44 is scanned or otherwise accessed, for example through window 102 of backer 16 to activate transaction product assembly 10. Upon accessing the account or record, then, at 306, value is added to the account or record in the form of monetary value, points, minutes, etc. Thus, transaction product assembly 10 is activated and loaded.

In one example, a predetermined value is associated with transaction product assembly 10 (i.e., associated with the account or record linked to transaction product assembly 10 via account identifier 44) prior to activation and display, but such predetermined value is not initially available for use toward the purchase or use of goods and/or services. In such an embodiment, at 304, transaction product assembly 10 is activated to permit subsequent access to the predetermined value (e.g., subsequent loading on and debiting from the account or record) and no additional value is added during activation such that operation 306 may be eliminated.

Once transaction product assembly 10 is activated and loaded, transaction product assembly 10 can be used by the consumer or any other bearer of transaction product assembly 10 to purchase goods and/or services at the affiliated retail setting (e.g., a retail store or web site) or can be used in exchange for calling minutes, etc. In one embodiment, where transaction product assembly 10 is displayed on a web site at 302, then, at 304, transaction product assembly 10 may be activated in any suitable method and may not require the physical scanning of account identifier 44 to be activated or to otherwise access the associated account or record such as at 306.

In one example, at 308, the retail store or other affiliated retail setting or web site accepts transaction product assembly 10, or perhaps just transaction card 40 of transaction product assembly 10, as payment toward the purchase of goods and/or services made by the current bearer of transaction product assembly 10. In particular, the value currently loaded on transaction product assembly 10 (i.e., stored or recorded in the account or record linked to account identifier 44) is applied toward the purchase of goods and/or services. At 310, additional value is optionally loaded on transaction card 40 at a point-of-sale terminal, kiosk or other area of the retail store, retail web site, or other related setting.

Upon accepting transaction card 40 as payment at 308, the retail store or related setting can subsequently perform either operation 308 again or operation 310 as requested by a current bearer of transaction card 40. Similarly, upon loading additional value on transaction card 40 at 310, the retail store or related setting can subsequently perform either operation 310 again or operation 308. In one example, the ability to accept transaction card 40 as payment for goods and/or services is limited by whether the account or record associated with transaction card 40 has any value stored or recorded therein at the time of attempted redemption.

Figure 15:
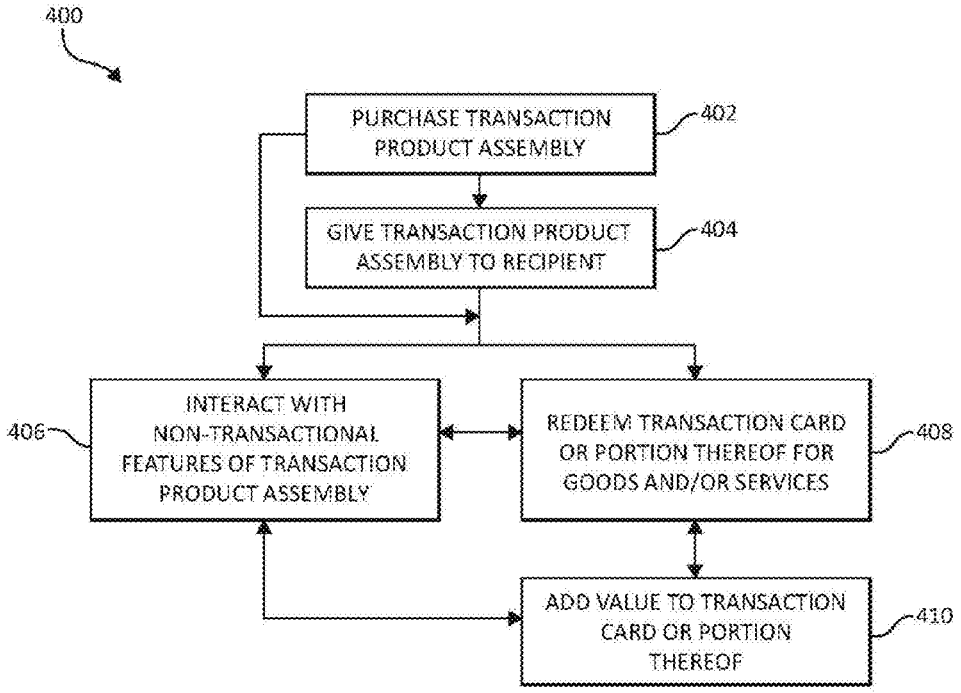
FIG. 15 is a flow chart illustrating a method of using a transaction product, according to one embodiment of the present invention.

FIG. 15 is a flow chart illustrating one embodiment of a method 400 of using transaction product assembly 10 including transaction card 40 (e.g., FIGS. 1-3). At 402, a potential consumer of transaction product assembly 10, which is displayed in a retail store or viewed on a web site, decides to and does purchase transaction product assembly 10 from the retail store or web site. Upon purchasing transaction product assembly 10, a retail store employee, a retail store kiosk or other person or device scans account identifier 44 (FIG. 3), for example, through window 102 of backer 16 or otherwise reads or accesses account identifier 44. Upon accessing account identifier 44, the account or record linked to account identifier 44 is accessed and activated to load value onto transaction product assembly 10 (i.e., load value to the account or record associated with transaction product assembly 10). In one embodiment, such as where transaction product assembly 10 is purchased at 402 via a web site, actual scanning or other mechanical detection of account identifier 44 may be eliminated.

At 404, the consumer optionally gives transaction product assembly 10 to a recipient, such as a graduate, relative, friend, expectant parents, one having a recent or impending birthday, a couple having a recent or impending anniversary, etc. In one embodiment, a plurality of transaction product assemblies 10 are purchased and given to partygoers, such as at a birthday party, etc. as party favors or gifts. As an alternative, the consumer can keep transaction product assembly 10 for his or her own use thereby eliminating operation 404.

At 406, the consumer, recipient or other current bearer of transaction product assembly 10 interacts with transaction product assembly 10. In one embodiment, playing or otherwise interacting with transaction product assembly 10 at 406 includes removing first parts member 12 and second parts member 14 from cavity 134 of clamshell member 18 and separating first parts member 12 and second parts member 14 from one another. Each of the plurality of parts 20 is removed from corresponding perimeter frames 24 and sprues 22 without the use of tools and/or aided by a scissors or similar object or sandpaper, etc. to eliminate or decrease the size of any residuals from sprues 22 on each of the plurality of parts 20, if any. After being separated from the corresponding perimeter frames 24, sprues 22, and other parts of the first part member 12 and second part member 14, the plurality of parts 20 are reassembled by placing ones of coupling features 26 such as cavities 26A, pegs 26B, stepped edges 26C, and alignment components 26D of ones of the plurality of parts 20 to mate with other ones of the coupling features 26 such as cavities 26A, pegs 26B, stepped edges 26C, and alignment components 26D to each other in a friction fit and/or other suitable manner to assemble the plurality of parts 20 to one another. As such, in one example, the reassembly assembly of the plurality of parts 20 is readily performed using a user's own hands and without the use of tools. Other methods of toolessly connecting the plurality of parts 20 using friction or similar fit will be apparent to those of skill in the art upon reading the present application.

In one example, once reassembled, for example, per instructional indicia 110 on backer 16, the plurality of parts 20 form a secondary assembly including a plane 28, stand 32, and base 33 as illustrated in FIG. 12, or any other suitable three-dimensional model, toy, or other object. The base 33 and stand 32 are selectively coupled with plane 28 to hold plane 28 above a supporting surface. Upon reading this application, those of skill in the art will appreciate that other methods of reassembling the plurality of parts 20 similar but differing somewhat to that above are also contemplated. In one example, interaction with transaction product assembly 10 at 406 amuses the bearer and any other observers of transaction product assembly 10.

At 408, the consumer or recipient redeems transaction card 40 of transaction product assembly 10 for goods and/or services from the retail store or web site. At 410, the consumer or recipient of transaction product assembly 10 optionally adds value to transaction card 40, more particularly, to the account or record associated with account identifier 44 included therewith, at the retail store or over the Internet (i.e., via the web site). Upon playing with transaction product assembly 10 at 406, redeeming transaction card 40 at 408 or adding value to transaction card 40 at 410, the consumer or recipient of transaction card 40 subsequently can perform either of operations 406, 408 or 410 as desired. In one embodiment, the ability of the consumer or recipient to repeat redeeming transaction card 40 at 410 is limited by whether the account or record linked with transaction card 40 has any remaining value stored or recorded therein at the time of attempted redemption.

Although primarily described above as occurring at a single retail store or web site, in one embodiment, purchasing transaction product assembly 10 at 402, redeeming transaction card 40 at 408 and adding value to transaction card 40 at 410, can each be performed at any one of a number of stores adapted to accept transaction card 40 or over the Internet. In one example, each of the number of stores is part of a chain or a group of similarly branded stores. In one example, the number of stores includes at least one web site and/or at least one conventional brick and mortar store.

Transaction products come in many forms, according to embodiments of the invention. The gift card, like other transaction products, can be "re-charged" or "re-loaded" at the direction of the original consumer, the gift recipient or a third party. The term "loading on" or "loaded on" herein should be interpreted to include adding to the balance of an account or record associated with a transaction product. The balance associated with the transaction product declines as the transaction product is used, encouraging repeat visits or use. The transaction product remains in the user's purse or wallet, serving as an advertisement or a reminder to revisit the associated merchant. Gift cards according to embodiments of the invention provide a number of advantages to both the consumer and the merchant. Other transaction products according to embodiments of the invention include loyalty cards, merchandise return cards, electronic gift certificates, calling cards, employee cards, frequency cards, prepaid cards and other types of cards associated with or representing purchasing power, monetary value, etc.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A transaction product assembly comprising:

a perimeter frame defining a footprint;

a plurality of parts maintained within the footprint of the perimeter frame;

a transaction card including a machine-readable account identifier linking the transaction card to an account or record, wherein the transaction card is maintained within the footprint of the perimeter frame; and a plurality of sprues extending between the perimeter frame, the plurality of parts, and the transaction card to hold the perimeter frame, the plurality of parts, and the transaction card together as a single piece;

wherein:

each of the plurality of parts are readily separable from the perimeter frame, the transaction card, and others of the plurality of parts by uncoupling the sprues from each of the plurality of parts, and the plurality of parts are configured to be reassembled with one another substantially without the use of tools to form at least a portion of a secondary assembly, areas within the footprint of the perimeter frame other than the plurality of parts, the transaction card, and the plurality of sprues remain substantially open and free of material, the perimeter frame, the plurality of parts, and the transaction card are all formed as part of a first parts member, and the transaction product assembly includes a second parts member selectively coupled to the first parts member, the second parts member including an additional plurality of parts for use in forming the secondary assembly, the second parts member includes a second perimeter frame with the additional plurality of parts being maintained within a footprint of the second perimeter frame, the second parts member defines an expanded void area within the footprint of the second perimeter frame free of any of the additional plurality of parts, and the expanded void area aligns with the transaction card of the first parts member such that the transaction card is visible through the expanded void area substantially without obstruction.

* * * * *